US009657540B2

(12) United States Patent
Coles et al.

(10) Patent No.: US 9,657,540 B2
(45) Date of Patent: May 23, 2017

(54) SYSTEM AND METHOD FOR WIRELINE TOOL PUMP-DOWN OPERATIONS

(75) Inventors: Randolph S. Coles, Spring, TX (US); Dipesh P. Ashar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 236 days.

(21) Appl. No.: 14/413,320

(22) PCT Filed: Jul. 16, 2012

(86) PCT No.: PCT/US2012/046857

§ 371 (c)(1),
(2), (4) Date: Jan. 7, 2015

(87) PCT Pub. No.: WO2014/014438

PCT Pub. Date: Jan. 23, 2014

(65) Prior Publication Data

US 2015/0167414 A1 Jun. 18, 2015

(51) Int. Cl.
*E21B 21/08* (2006.01)
*E21B 45/00* (2006.01)
(Continued)

(52) U.S. Cl.
CPC ..... *E21B 21/08* (2013.01); *E21B 45/00* (2013.01); *E21B 47/0006* (2013.01); *E21B 47/122* (2013.01)

(58) Field of Classification Search
CPC ..... E21B 21/08; E21B 45/00; E21B 47/0006; E21B 47/122; E21B 47/00
See application file for complete search history.

(56) References Cited

U.S. PATENT DOCUMENTS 4,252,190 A 2/1981 Jageler et al.
4,597,440 A 7/1986 Pottier
(Continued)

FOREIGN PATENT DOCUMENTS

WO WO 2009/143469 11/2009
WO WO 2012/021126 2/2012
WO WO 2012/082302 6/2012

OTHER PUBLICATIONS

Australian Government IP Australia, Patent Examination Report No. 1, Australian Application No. 2012385499, Dec. 14, 2015, 3 pages.

(Continued)

*Primary Examiner* — Yong-Suk (Philip) Ro
(74) *Attorney, Agent, or Firm* — Scott Richardson; Parker Justiss, P.C.

(57) ABSTRACT

A system for pump down operations in a wellbore includes a tool string disposed in a wellbore, the tool string including a cable head having an upper end coupled to an electric wireline cable, a downhole tool coupled to the cable head, the downhole tool selected from the group consisting of perforating tools and downhole logging tools. In this embodiment, the system further includes a downhole tension sensor located proximal to the upper end of the cable head, the sensor adapted to obtain downhole wireline tension data and transmit the downhole wireline tension data via the electric wireline cable, a fluid pump with a fluid output operatively connected to the wellbore above the tool string, and a controller adapted to selectively adjust a pump fluid output rate of the fluid pump during pump down operations based on the downhole wireline tension data received from the downhole tension sensor.

26 Claims, 4 Drawing Sheets

(51) Int. Cl.
*E21B 47/00* (2012.01)
*E21B 47/12* (2012.01)

(56) References Cited

U.S. PATENT DOCUMENTS

| | | | |
|---|---|---|---|
| 4,662,209 | A | 5/1987 | Brown |
| 5,522,260 | A | 6/1996 | Chappellat et al. |
| 6,145,378 | A | 11/2000 | McRobbie et al. |
| 6,148,263 | A | 11/2000 | Brooks et al. |
| 6,394,184 | B2 | 5/2002 | Tolman et al. |
| 6,618,675 | B2 | 9/2003 | Strickland |
| 6,662,645 | B2 | 12/2003 | Brewer |
| 6,704,655 | B2 | 3/2004 | Kelly |
| 6,896,056 | B2 | 5/2005 | Mendez et al. |
| 7,142,985 | B2 | 11/2006 | Edwards |
| 7,225,879 | B2 | 6/2007 | Wylie et al. |
| 7,350,410 | B2 | 4/2008 | Ekseth et al. |
| 7,363,967 | B2 | 4/2008 | Burris et al. |
| 7,475,486 | B1 | 1/2009 | Fitzgerald et al. |
| 7,696,901 | B2 | 4/2010 | Wilson et al. |
| 8,037,934 | B2 | 10/2011 | Strickland |
| 8,061,443 | B2 | 11/2011 | Hall et al. |
| 2009/0107725 | A1 | 4/2009 | Christy et al. |
| 2009/0129942 | A1 | 5/2009 | Dorado et al. |
| 2010/0300685 | A1 | 12/2010 | Del Campo et al. |
| 2013/0062055 | A1 | 3/2013 | Tolman et al. |
| 2013/0255939 | A1 | 10/2013 | Kumaran et al. |
| 2014/0131035 | A1 | 5/2014 | Entchev et al. |

OTHER PUBLICATIONS

Authorized Officer Mineko Mohri, PCT International Preliminary Report on Patentability, PCT/US2012/046857, Jan. 29, 2015, 9 pages.

International Search Report and Written Opinion of the International Searching Authority issued in International Application No. PCT/US2012/046857 on May 29, 2013; 12 pages.

Seals et al., "Automated Controls for Pump Down Operations," International Application No. PCT/US10/44999, filed Aug. 10, 2010, 54 pages.

International Search Report and Written Opinion of the International Searching Authority issued in International Application No. PCT/US2012/046867 on Mar. 25, 2013, 11 pages.

SYSTEM AND METHOD FOR WIRELINE TOOL PUMP-DOWN OPERATIONS

CLAIM OF PRIORITY

This application is a U.S. National Stage of International Application No. PCT/US2012/046857, filed Jul. 16, 2012.

TECHNICAL FIELD

The present disclosure relates to systems, assemblies, and methods for conveying perforating and/or logging tools (hereinafter referred to as a "tool string") in a wellbore where adverse conditions may be present to challenge downward movement of the tool string in the wellbore.

BACKGROUND

In oil and gas exploration it is important to obtain diagnostic evaluation logs of geological formations penetrated by a wellbore drilled for the purpose of extracting oil and gas products from a subterranean reservoir. Diagnostic evaluation well logs are generated by data obtained by diagnostic tools (referred to in the industry as logging tools) that are lowered into the wellbore and passed across geologic formations that may contain hydrocarbon substances. Examples of well logs and logging tools are known in the art. Examples of such diagnostic well logs include Neutron logs, Gamma Ray logs, Resistivity logs and Acoustic logs. Logging tools frequently are used for log data acquisition in a wellbore by logging in an upward (up hole) direction, from a bottom portion of the wellbore to an upper portion of the wellbore. The logging tools, therefore, need first be conveyed to the bottom portion of the wellbore. In many instances, wellbores can be highly deviated, or can include a substantially horizontal section. Such wellbores make downward movement of the logging tools in the wellbore difficult, as gravitational force becomes insufficient to convey the logging tools downhole.

SUMMARY

The present disclosure relates to systems, assemblies, and methods for conveying perforating and/or logging tools (hereinafter referred to as a "tool string") in a wellbore where adverse conditions may be present to challenge downward movement of the tool string in the wellbore. The disclosed systems, assemblies, and methods can reduce risk of damage to the tool string and increase speed and reliability of moving the tool string into and out of wellbores. For example, certain wells can be drilled in a deviated manner or with a substantially horizontal section. In some conditions, the wells may be drilled through geologic formations that are subject to swelling or caving, or may have fluid pressures that make passage of the tool string unsuitable for common conveyance techniques. The present disclosure overcomes these difficulties and provides several technical advances.

The present disclosure relates generally to a pump down tool string that is connected to the lower end of an electric wireline or slickline cable that is spooled off a truck located at the surface. As used herein the terms "cable" and "line" and "wireline" are used interchangeably and unless described with more specificity may include an electric wireline cable or a slickline cable. The subject method and system is used in some implementations in a cased wellbore or in other implementations is applicable in a partially cased wellbore. The tool string is especially adapted for use in highly deviated wellbores wherein it is a known practice to pump fluid from the surface behind a tool string to assist the tool in moving down the deviated wellbore.

General background of pump down tool technology is known in the art and is disclosed in pending application PCT/US/2010/44999. The automated pump-down system described in the afore referenced PCT patent application depends on sensor data to provide line tension and line speed. Typically, these readings would come from sensors and calculations done at the surface as prior art pump down operations do not include a tool string that has the capability to transmit this information from the tool string. Using surface data to describe events happening in the wellbore is not optimum due to the delay in the response of the sensors at the surface as well as the inaccuracies caused by the effect of wellbore conditions on the readings. Changes in tension at the cable head of the tool string and real tool string speed would not be instantaneously measured due to dampening effects of stretching of the wireline cable and different wellbore fluids. Accuracy of those measurements would also be affected by cable stretch, wellbore fluids, and well geometry.

If the pump pressure of the fluid behind the tool string is too great it may result in excessive downhole tension on the cable head that will result in breaking the cable or pulling the cable out from the cable head. It is desirable to control the pump pressure or line speed of the cable to keep the tension in the cable within safe parameters.

In some implementations, the pump down tool string of the present disclosure includes a device that measures the tension in the cable at the cable head and transmits that data as an analog signal to the surface via an electric wireline cable or other transmission means, and uses that data to control pumps and/or line speed.

Additionally, in some implementations the pump down tool string of the present disclosure may include a device that calculates the speed of the downhole tool string at the cable head and transmits that data as an analog or digital signal. (Examples of such devices include an accelerometer and/or a casing collar locator.)

In a first aspect, a system for pump down operations in a wellbore includes a tool string disposed in a wellbore, said tool string including a cable head having an upper end coupled to an electric wireline cable, a downhole tool coupled to the cable head, the downhole tool selected from the group consisting of perforating tools and downhole logging tools, and a downhole tension sensor located in the cable head, are alternatively located elsewhere in the tool string, said sensor adapted to obtain downhole wireline tension data and transmit the downhole wireline tension data via the electric wireline cable, a fluid pump with a fluid output operatively connected to the wellbore above the tool string, and a controller adapted to selectively adjust a pump fluid output rate of the fluid pump during pump down operations based on the downhole wireline tension data received from the downhole tension sensor.

Various implementations can include some, all, or none of the following features. The system can also include a wireline speed sensor in communication with the controller, wherein the controller is adapted to selectively adjust the pump fluid output rate during pump down operations based on wireline speed data received from the wireline speed sensor. The wireline speed sensor can be located at the surface and measures the speed of the wireline as the wireline is spooled into the wellbore. The tool speed sensor can be disposed proximal to the cable head and the speed sensor can calculate the speed of the device at the cable head and can transmit that data to a system that communicates with one or more controllers. The tool speed sensor can include a casing collar locator disposed in the tool string and one or more controllers which can calculate the speed at which the casing collar locator is passing between known casing collars spaced apart at previously known distances between the known casing collars. The controller can compare the calculated speed as the casing collar locator passes additional known casing collars and can determine if the speed of the tool string is increasing or decreasing.

In a second aspect, a system for pump down operations in a wellbore includes a tool string disposed in a wellbore, said tool string including a cable head having an upper end coupled to an electric wireline cable, and a downhole tool coupled to the cable head, the downhole tool selected from the group consisting of perforating tools and downhole logging tools, a fluid pump with a fluid output operatively connected to the wellbore above the tool string, and a downhole tool speed sensor in communication with a system that is connected to the controller, wherein the controller is adapted to selectively adjust a pump rate during pump down operations based on wireline speed data received from the downhole tool speed sensor.

Various implementations can include some, all, or none of the following features. The downhole tool speed sensor can be an accelerometer disposed proximal to the cable head and wherein the tool speed sensor calculates the speed of the device at the cable head and transmits that data to a system that is in communication with one or more controllers. The downhole tool speed sensor can include a casing collar locator disposed in the tool string and one or more controllers which can calculate the speed at which the casing collar locator is passing between known casing collars spaced apart at previously known distances between the known casing collars. The controller can compare the calculated tool speed as the casing collar locator passes additional known casing collars and can determine if the speed of the tool string is increasing or decreasing. The controller can adjust either the speed at which the wireline is spooled off at the surface or the pump output based on the downhole tool speed. The system can also include a downhole tension sensor incorporated in the cable head, or alternatively located elsewhere in the tool string, said sensor adapted to obtain downhole wireline tension data and transmit the downhole wireline tension data to the surface. The controller can be adapted to adjust the pump rate based on the downhole wireline speed data unless the downhole wireline tension reaches a predetermined tension threshold, after which the controller can automatically reduce a surface wireline speed of a wireline unit and the pump rate. The controller can be adapted to selectively adjust the pump rate during pump down operations based on downhole wireline tension data received from the downhole tension sensor. The controller can selectively adjust the wireline speed during pump down operations based on wireline tension data received from the downhole tension sensor. The system can also include a pump rate sensor in communication with the controller, wherein the controller can selectively adjust the wireline speed during pump down operations based on pump rate data received from the pump rate sensor. The controller can automate at least one control function selected from the group consisting of: a pump fluid output rate for the pump unit based on at least one of a monitored wireline speed and a monitored wireline tension, and a wireline speed based on at least a monitored pump rate for the pump. The controller can include a wireline controller typically located at the surface and a pump controller that is part of the pump. If the wireline controller notifies the pump controller that a monitored tool speed is less than a predetermined threshold, the pump controller can increase a pump rate of the pump unit in response to said notification. If the wireline controller notifies the pump controller that a monitored wireline tension is more than a predetermined threshold, the pump controller can decrease a pump rate of the pump unit in response to said notification. If the pump controller notifies the wireline controller that a monitored pump rate is less than a predetermined threshold, the wireline controller can decrease a wireline speed in response to said notification.

In a third aspect, a method for pumping a tool string connected to an electric wireline into a wellbore includes inserting a logging tool string into a proximal upper end of the wellbore, said logging tool string including a cable head attached to a cable, a downhole tension sensor located in the cable head, or alternatively, proximal to the cable head, said sensor adapted to obtain downhole wireline tension data and transmit the downhole wireline tension data via the electric wireline cable, and a downhole wireline speed sensor, pumping a fluid into the upper proximal end of the wellbore above the tool string to assist, via fluid pressure on the tool string, movement of the tool string down the wellbore, spooling out the cable at the surface as the fluid is pumped behind the tool string and the tool string is moving down the wellbore, receiving by one or more controllers downhole wireline tension data from the downhole tensions sensor via the electric wireline cable, and receiving by the one or more controllers data from the casing collar locator via the electric wireline cable.

Various aspects can include some, all, or none of the following features. The method can also include determining if the downhole tool string speed is increasing or decreasing. The method can also include monitoring, by a controller, a downhole wireline speed, monitoring, by the controller, a downhole wireline tension, and automatically controlling, by the controller, a pump rate for pumping the tool into the wellbore based on at least one of the monitored downhole tool speed and monitored downhole wireline tension. The method can also include receiving downhole sensor data and determining the tool speed and the wireline tension from the sensor data. The method can also include increasing the pump rate in response to a reduction in the monitored tool speed. The method can also include changing the pump rate in accordance with a difference between the monitored tool speed and a predetermined threshold. The method can also include changing the wireline speed at the surface in response to a monitored pump rate. The method can also include monitoring by a controller a pump rate for pumping the tool into the wellbore, and automatically controlling, by the controller, a tool speed for the tool being pumped into the wellbore based on at least the monitored pump rate.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an inclusive fashion, and thus should be interpreted to mean "including, but not limited to." Unless otherwise specified, any use of any form of the terms "connect," "engage,", "couple," "attach,", or any other term describing an interaction between elements is not meant to limit the interaction to direct interaction between the elements and may also include indirect interaction between the elements described. Reference to up or down will be made for purposes of description with "up," "upper," "upwardly" or "upstream" meaning toward the surface of the well and with "down," "lower," "downwardly" or "downstream" meaning toward the terminal end of the well, regardless of the wellbore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Disclosed herein are systems and methods for automated monitoring and control of pump down operations. More specifically, the pump rate of a pump unit (or units), the line speed for a logging/perforating (L/P) unit, and the line tension for the L/P unit may be automatically monitored and controlled to enable efficient pump down operations. In at least some embodiments, pump down operations may be based on a predetermined line speed, a predetermined line tension and/or a predetermined pump rate. However, if any of these parameters change during pump down operations, the other parameters will be adjusted automatically. The techniques disclosed herein improve safety of pump down operations by eliminating the possibility of pumping the tools off the end of the wireline cable or other catastrophes.

As a specific example, if the monitored line tension surpasses a desired threshold, the line speed will be automatically reduced to maintain the desired line tension and the pump rate will be reduced in accordance with the amount of change in the line speed. Thereafter, if the monitored line tension drops below the predetermined threshold, the line speed will be automatically increased (up to a desired line speed) and the pump rate will be increased in accordance with the line speed. Similarly, changes in the monitored pump rate during pump down operations may result in automated changes to the line tension and/or line speed of the L/P unit.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
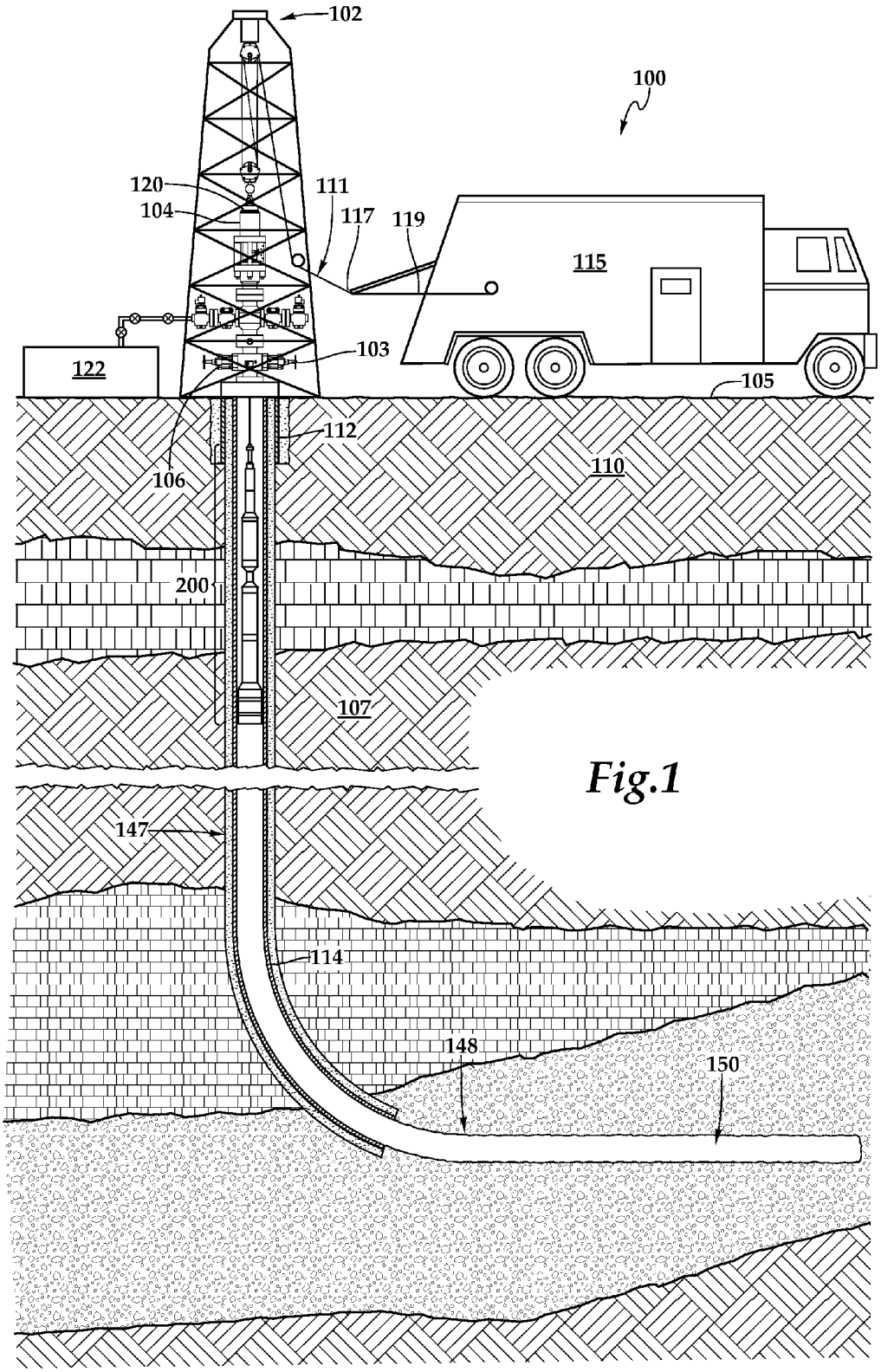
FIG. 1 is a side schematic that illustrates operations of a logging tool conveying system.
Figure 5:
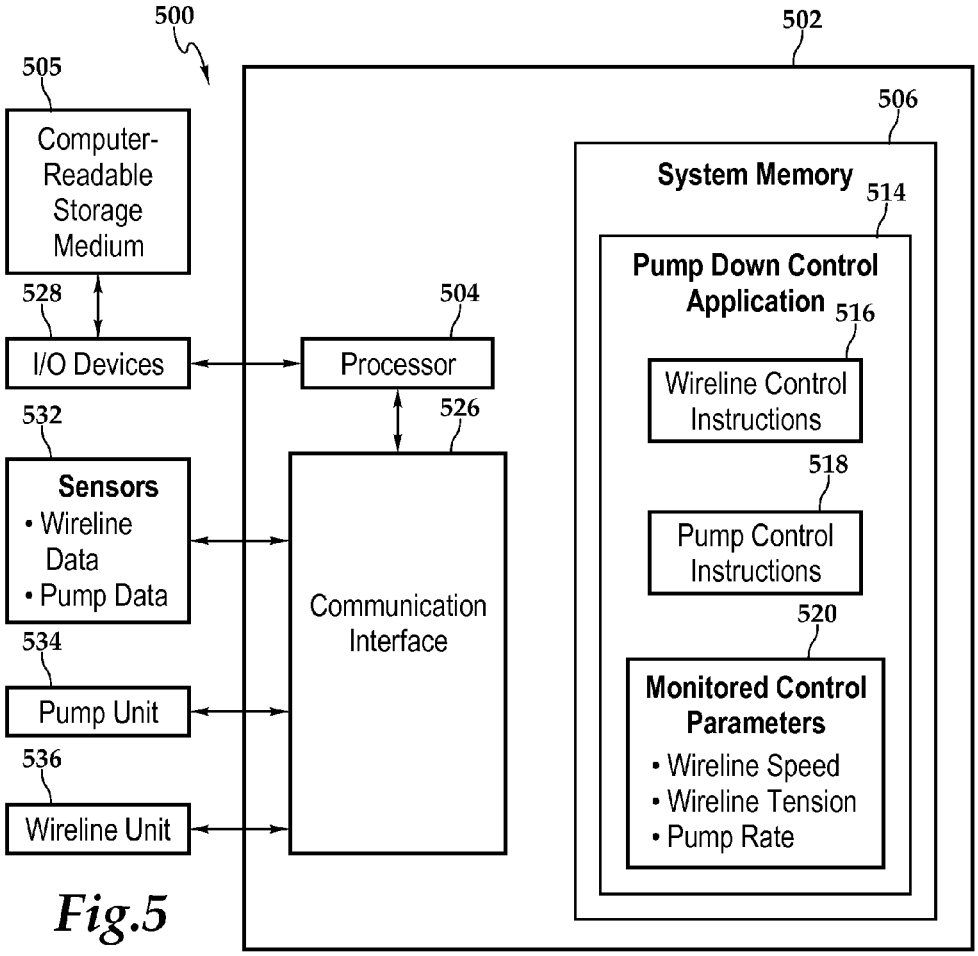
FIG. 5 illustrates a block diagram of a pump down control application.
Figure 6:
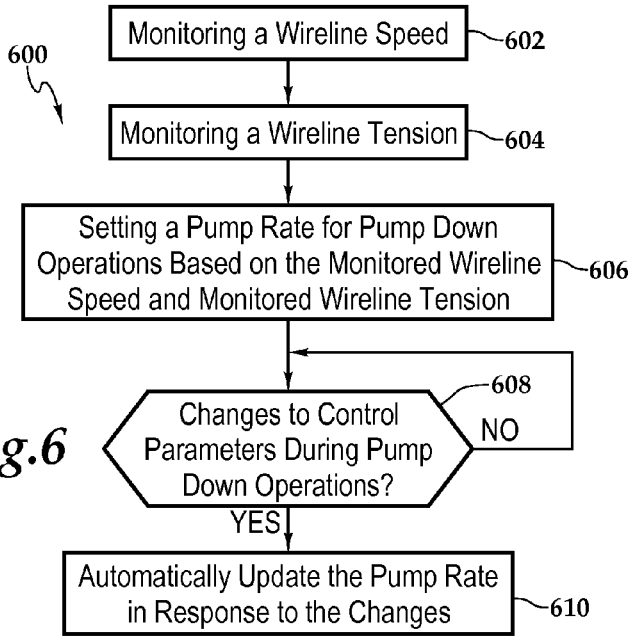
FIG. 6 illustrates a method 600 in accordance with an embodiment of the disclosure.
Figure 7A:
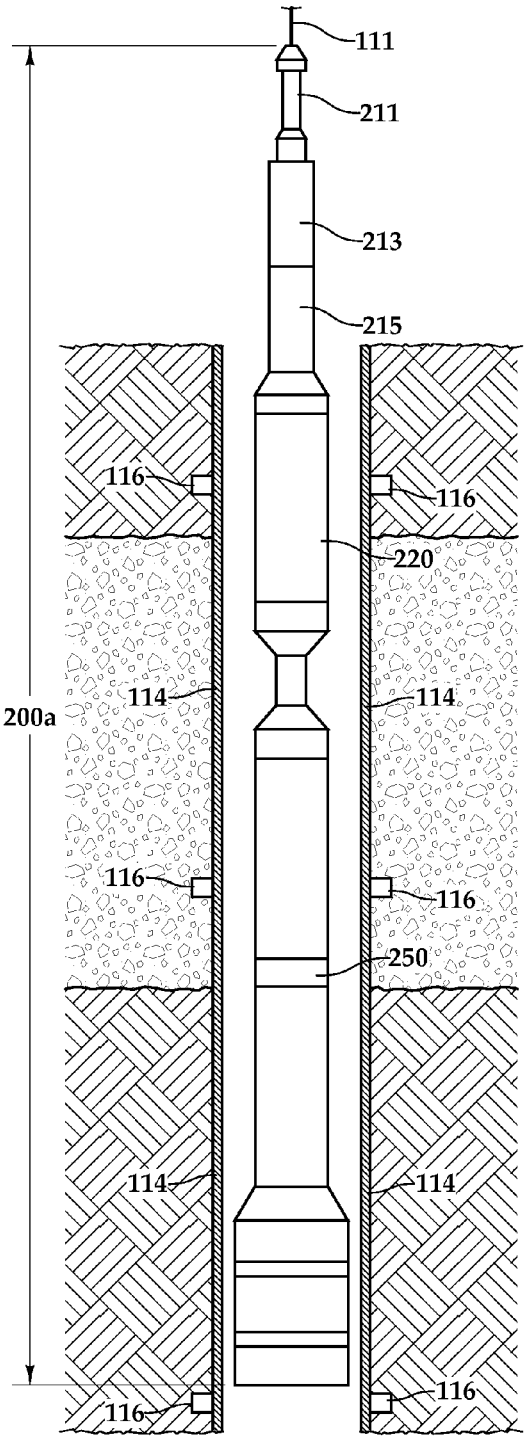
FIG. 7A is a side view of a logging tool string assembly applicable to operations illustrated in FIG. 1.
Figure 7B:
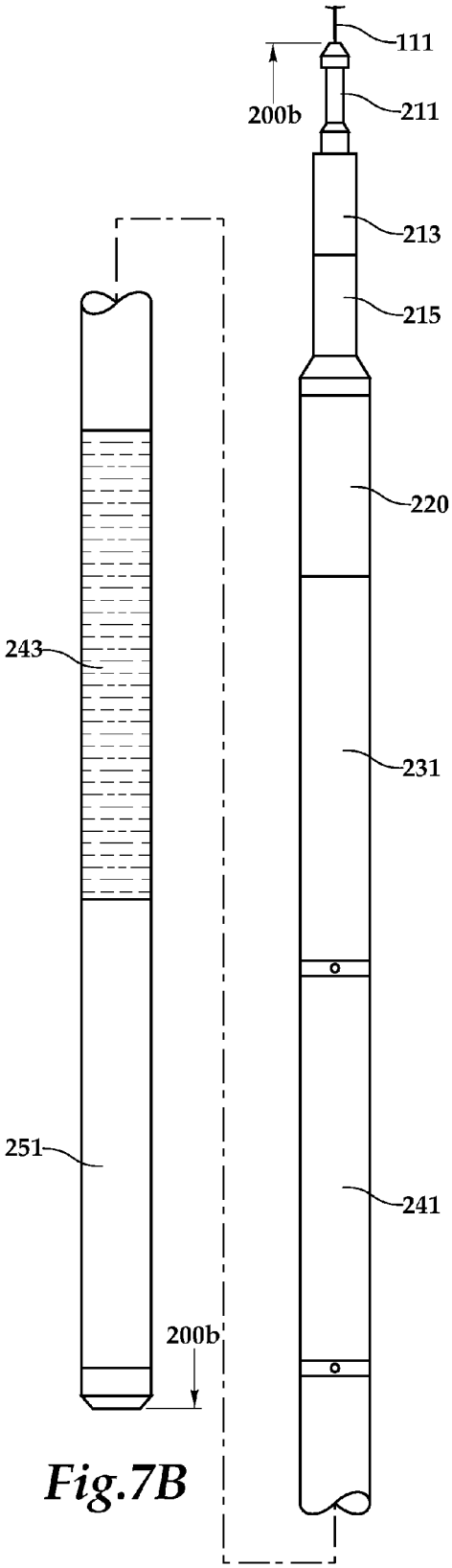
FIG. 7B is a side view of a perforation tool assembly applicable to the operations illustrated in FIG. 1.

FIGS. 1 to 6 illustrate operations of a pump down tool string 200 (including implementations of the tool string 200*a* and 200*b* of FIGS. 7A and 7B). The system 100 includes surface equipment above the ground surface 105 and a wellbore 150 and its related equipment and instruments below the ground surface 105. In general, surface equipment provides power, material, and structural support for the operation of the pump down tool string 200. In the embodiment illustrated in the side schematic of FIG. 1, the surface equipment includes a drilling rig 102 and associated equipment, and a data logging and control truck 115. The rig 102 may include equipment such as a rig pump 122 disposed proximal to the rig 102. The rig 102 can include equipment used when a well is being logged or later perforated such as a tool lubrication assembly 104 and a pack off pump 120. In some implementations a blowout preventer 103 will be attached to a casing head 106 that is attached to an upper end of a well casing 112. The rig pump 122 provides pressurized drilling fluid to the rig and some of its associated equipment. A wireline and control truck 115 monitors the data logging operation and receives and stores logging data from the logging tools and/or controls and directs perforation operations. Below the rig 102 is the wellbore 150 extending from the surface 105 into the earth 110 and passing through a plurality of subterranean geologic formations 107. The wellbore 150 penetrates through the formations 107 and in some implementations forms a deviated path, which may include a substantially horizontal section as illustrated in FIG. 1. The wellbore 150 may be reinforced with one or more casing strings 112 and 114.

The tool string 200 may be attached with a cable/wireline 111 via a cable head 211. The conveying process is conducted by pumping a fluid from the rig pump 122 into the upper proximal end of the casing string 112 (or 114) above the tool string 200 to assist, via fluid pressure on the tool string 200, movement of the tool string 200 down the wellbore 150. The pump pressure of the fluid above the tool string 200 is monitored, for example, by the truck 115, because the fluid pressure can change during the conveying process and exhibit patterns indicating events such as sticking of the tool string in the wellbore. As the tool string 200 is pumped (propelled) downwards by the fluid pressure that is pushing behind the tool string 200, the cable 111 is spooled out at the surface by the truck 115. A cable tension sensing device 117 is located at the surface and provides cable tension data to control track 115. A speed sensor device 119 located at the surface provides surface cable speed data to control track 115.

In some implementations the tool string will have sufficient weight that gravity will convey the tool string down the wellbore without the assistance of pump fluid pressure.

FIG. 7A is a side view of an exemplary logging tool string 200*a* and 200*b* applicable to the operations of a general tool string 200 illustrated in FIGS. 1 to 6. In some implementations the tool string 200 may be implemented and tool string 200*a* as illustrated in FIG. 7A and include various data logging instruments used for data acquisition; for example, a casing collar locator 220, a telemetry gamma ray tool 231, a density neutron logging tool 241, a borehole sonic array logging tool 243, a compensated true resistivity tool array 251, among others as are well known in the art.

The tool string is securely connected with the cable 111 by cable head tool 211. The tool string may include a downhole tension sensing device 213 and a downhole speed sensing device such as an accelerometer 215. As the tool string 200 is propelled down the bore of the drill string by the fluid pressure, the rate at which the cable 111 is spooled out maintains movement control of the tool string 200 at a desired speed.

In other possible configurations, the tool string 200 may include other data logging instruments besides those discussed in FIG. 7A, or may include a subset of the presented instruments.

Referring to FIG. 7B, in other implementations the tool string 200 may be implemented as tool string 200*b* as illustrated and include the casing collar locator 220, a firing head and perforating gun 250, as are well known in the art. In some implementations the tool string 200 includes a tension load cell 213 and/or triaxial accelerometer speed sensing device 215.

Referring to FIG. 7A, wherein an exemplary tool string 200*a* is illustrated inside a casing string 114. Casing collars 116 are couplings that connect two joints of pipe together. The coupling adds mass to the casing string 114 at the connections and the change in mass can be measured. In most cased wellbores, there will be an existing record of the location of the casing collars relative to the actual known depth of most casing collars in the wellbore trajectory. This is typically done by running a log with a gamma ray detector and a casing collar locator. The actual known depth of the casing collars is entered into a processor.

As used herein with regard to speed calculations and speed adjustments and corrections factors, the term "actual known depth" is the depth as determined from the casing collar locator log. The depth may also be referred to as the "expected depth." The measured depth is the depth as calculated based on the measured amount of cable/line spooled out and measured at the surface.

In some methods of operations of the tool string 200, 200*a*, 200*b*, before entering a section of the wellbore that is highly deviated from vertical, a casing collar at a known depth will be recorded and the current depth will be adjusted or the delta will be noted. The line will be spooled into the well, the casing collar locator data, as well as the downhole line tension data will be transmitted uphole to a surface processor that is part of the system. Downhole tension data is used in speed correction algorithms that use line tension. As the tool passes a casing collar, the depth of the collar will be noted as well as the time. The average line or tool speed over the interval between collars will be calculated and compared to the average line or tool speed measured at the surface and the average calculated downhole speed. The recorded depth of the casing collar will be compared to the expected actual depth. The expected actual depth of the casing collar is based on previously recorded measurements used to determine the actual depth of the casing collar. This could be a Gamma Ray/CCL log or some other method of correlating the casing collar depth to the reference depth for the well.

Figure 2:
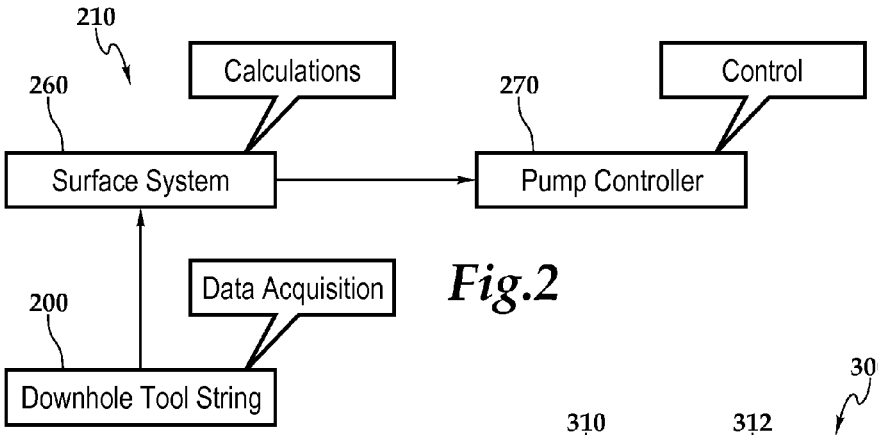
FIG. 2 illustrates a conceptual block diagram of a logging tool conveying system.

FIG. 2 illustrates a conceptual block diagram of the logging tool conveying system 210. During the pump down operations illustrated and described in FIGS. 1 to 7B, automated monitoring and control of various operational parameters are performed. In at least some embodiments, the pump rate of a pump unit (or units), the line speed for a logging/perforating (L/P) unit, and the line tension for the L/P unit may be sensed by a downhole tool string 200, 200*a*, 200*b* may be automatically monitored by a surface system 260, and controlled by a pump controller 270 to enable efficient pump down operations. Of course, the automatic monitoring and control of parameters such as the propelling force and rate for advancing the tool string into the borehole, the line speed for a wireline unit, and the line tension for the wireline unit is useful for any wireline tool in which the tool string is conveyed into the borehole (cased or uncased) and where it is desired to coordinate control of both the pumping unit and the feed of the tool on the wireline. Such principles may be applied to any wireline logging tool, for example. Although a pumping unit is typical for use in pump down operations, other driving units are known which may be used for advancing wireline tools, such as powered tractors, and it is equally important that the driving force be balanced with wireline speed and wireline tension for such tools also.

As a specific example, suppose it is desired to run a tool string at a line speed of 500 feet per minute in the vertical portion 147 of wellbore 150 and run the tool at a line speed of 375 feet per minute in the horizontal portion 148 of wellbore 150. Further, suppose the L/P control unit is always trying to hold 3000 lbs of tension on tools going in the hole. For this set of desired parameters, the L/P control unit initially sets the line tension parameter at 3000 lbs and the line speed parameter at 500 ft/min (for vertical portion 47) and later 375 ft/min (for horizontal portion 48). In response, the tech control center (TCC)/pump control unit automates the pump rate to achieve the L/P variables. Once the tool string starts down wellbore 10, the TCC/pump sets an auto pump rate that ramps up to the L/P variables (e.g., within 30 seconds or so). If any of these parameters change during the pump down operations, the other parameters will be adjusted automatically. The techniques disclosed herein improve safety of pump down operations by eliminating the possibility of pumping the tools off the end of the wireline cable or other catastrophes.

Figure 3:
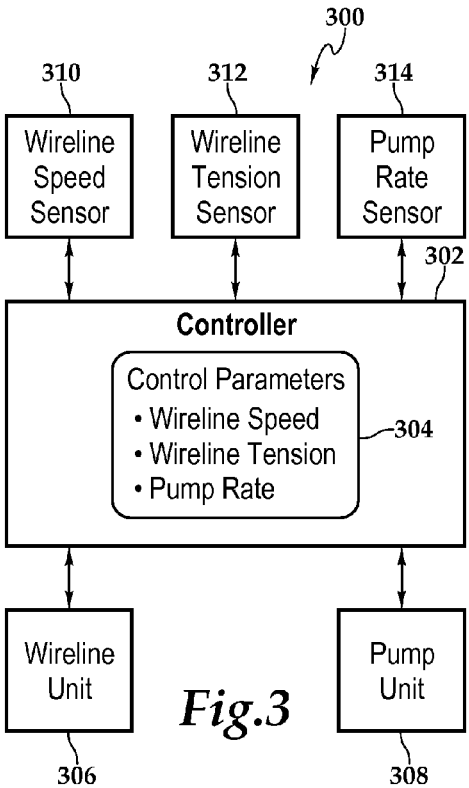
FIG. 3 illustrates a block diagram of a control system for pump down operations.

FIG. 3 illustrates a block diagram of a control system 300 for pump down operations of the tool string 200 in accordance with an embodiment of the disclosure. The control system components are most usefully located at the surface, as part of the wireline unit, pumping unit or as part of a separate remote control unit. Surface control components facilitate access for maintenance and ensuring accurate control signal transmission to the wireline unit and pumping unit. It is equally possible, however, for some or all components of the control system to be installed on the downhole tool. Such an arrangement may be appropriate where it is desired to integrate the combined control functionality for the wireline unit and pumping unit into the tool itself (e.g., where the tool may be a separately provided integer from the wireline unit and is configured to interface with each of the wireline unit and the pumping unit). In such cases, the tool is ideally provided along with a remote input/output device for monitoring and/or setting control parameters for the tool/control system from the surface. As shown, the control system 300 comprises a controller 302 coupled to a wireline unit 306 and to a pump unit 308. The controller 302 may replace one or both of the individual controllers usually provided to each of the wireline unit 306 and pump unit 308. Where only one of the individual controllers is replaced, the controller 302 is configured to interface with the existing controller of the other unit. Alternatively, an entirely separate controller 302 may be provided that is configured to interface with the existing individual control units of both the wireline unit 306 and pumping unit 308. Advantageously, the controller 302 may be configured to interface with the individual control units of a wide range of existing pumping units and wireline units, making the controller adaptable to different wireline and pumping equipment, including the equipment of different manufacturers and/or a variety of different wireline tools. In some applications, the interface between controller 302 and the pumping unit 308 and/or wireline unit 306 may be wireless, for example, via WiFi, Bluetooth or over a telephone or internet connection, for example. Appropriate transmitter/receiver equipment may be connected to the wireline unit 306 and pumping unit 308 to permit the controller 302 to interface with them. The controller 302 is thereby able to be configured to provide commands to the wireline unit 306 to control wireline movement during pump down operations, such as pump-and-perf operations. The controller 302 may also be configured to provide commands to the pump unit 308 to control pumping during pump down operations. This may obviate the necessity for a separate operator to control each of the wireline unit 306 and the pumping unit 308, the pump down operation able to precede either entirely automatically under the control of controller 302, or with input from a single operator into the controller 302. In at least some embodiments, the controller 302 relies on control parameters 304 (e.g., a wireline speed parameter, a wireline tension parameter, and a pump rate parameter) to generate appropriate commands to the wireline unit 306 and pump unit 308.

Data corresponding to the control parameters 304 are received from system sensors, which are arranged to monitor the respective control parameters from appropriate locations on the pumping unit, wireline unit and/or wireline tool, or otherwise on the drilling platform or in the wellbore, and are coupled to the controller 302. Pressure also may be monitored by the controller 302 to account for pumping limitations.

In at least some embodiments, a wireline speed sensor 310, a wireline tension sensor 312, and a pump rate sensor 314 provide sensor data to the controller 302. Other sensor data might be relayed to the controller, for example, relating to the position and/or orientation of the wireline tool in the wellbore. The sensor data from the wireline speed sensor 310 may correspond directly to wireline speed data or to data that enables the wireline speed to be calculated. The sensor data from the wireline tension sensor 312 may correspond directly to wireline tension data or to data that enables the wireline tension to be calculated. The sensor data from the pump rate sensor 314 may correspond directly to pump rate data or to data that enables the pump rate to be calculated.

During pump down operations, such as pump-and-log or pump-and-perf, the controller 302 analyzes new sensor data from the sensors 310, 312, 314 and is configured to automatically direct the pump unit 308 to adjust its pump rate in response to changes in a monitored wireline speed and/or monitored wireline tension. Additionally, the controller 302 may automatically direct the wireline unit 306 to adjust its wireline speed in response to changes in a monitored pump rate. For example, the controller 302 may direct the pump unit 308 to increase its pump rate in response to a decrease in the monitored wireline speed in order to maintain the speed at which the tool is advanced. Of course, this action assumes the wireline tension to be unchanging, or changing proportional to speed. If, to the contrary, the wireline tension is decreasing at a non-proportional rate to the rate at which the speed is decreasing, this would likely indicate that the tool is entering debris, and the appropriate action would then be to decrease the pump rate, or shut off the pump altogether, in order to prevent the tool getting stuck. It will therefore be appreciated that control of the pump rate in dependence on the wireline speed will preferably also be dependent upon the wireline tension. Additionally or alternatively, the controller 302 may direct the wireline unit 306 to reduce its wireline speed and/or direct the pump unit 308 to reduce its pump rate in response to an increase in the monitored wireline tension. In at least some embodiments, comparisons of control parameter values to predetermined threshold values (e.g., greater than or less than comparisons) for wireline speed, wireline tension, and pump rate may be considered by the controller 302 in addition to (or instead of) directional changes (an increase/decrease) for the control parameters.

Figure 4A:
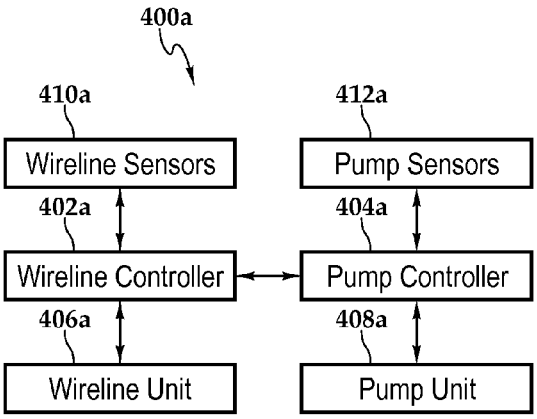
FIGS. 4A and 4B illustrate other control systems which may be distributed between the wireline unit, pumping unit, the wireline tool, and a separate controller.
Figure 4B:
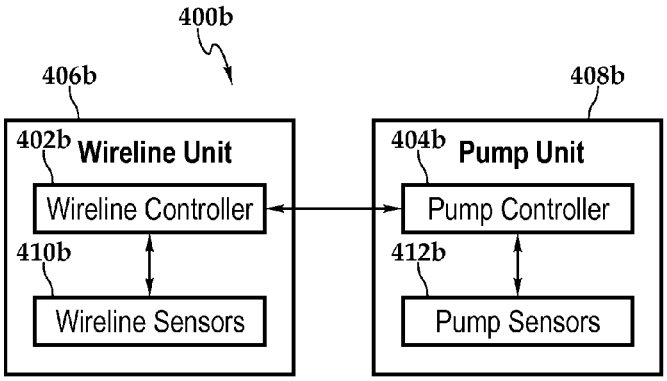

FIGS. 4A-4B illustrate other control systems which may be distributed between the wireline unit 306, pumping unit 308, the wireline sensors 410A, and a separate controller, as desired. The distributed control systems are suitable for controlling pump down operations, such as pump-and-perf and pump-and-log, in accordance with embodiments of the disclosure.

In system 400A of FIG. 4A, distributed control of a wireline unit 406A and a pump unit 408A are illustrated. In other words, the wireline controller 402A and the pump controller 404A perform the functions described for the controller 302, except in a distributed manner. More specifically, wireline controller 402A directs commands to the wireline unit 406A, while pump controller 404A directs commands to the pump unit 408A. In order to account for changes that may occur in the control parameters (e.g., wireline speed, wireline tension, and pump rate), the wireline controller 402A and the pump controller 404A are configured to communicate. Such changes may be detected based on sensor data gathered from wireline sensors 410A coupled to the wireline controller 402A. Additionally, the pump controller 404A may gather sensor data from pump sensors 412A coupled thereto. The amount of information exchanged between wireline controller 402A and pump controller 404A may vary for different embodiments. For example, wireline controller 402A and pump controller 404A may be configured to exchange sensor data periodically. Additionally or alternatively, wireline controller 402A and pump controller 404A may be configured to send requests as needed (e.g., the wireline controller 402A may request that the pump controller 404A reduce the pump rate or the pump controller 404A request that the wireline controller 402A reduce the wireline speed). The amount of reduction related to each request may be communicated with the request, deduced, or preset for each controller 402A, 404A. Increases in pump rate and wireline speed are likewise possible and may be requested between distributed controllers such as controllers 402A and 404A.

In system 400B of FIG. 4B, another embodiment of distributed controllers for pump down operations is illustrated. As shown, wireline controller 402B and wireline sensors 410B are incorporated into wireline unit 406B. Similarly, pump controller 404B and pump sensors 412B are incorporated into pump unit 408B. In at least some embodiments, the wireline unit 406B and the pump unit 408B are configured to communicate to each other to automate control of a pump rate and wireline speed during pump down operations. Wireline tension also may be considered and may affect the control of both the pump rate and the wireline speed during pump down operations. Similar to the discussion of FIG. 4A, the amount of information exchanged between wireline controller 402B and pump controller 404B may vary for different embodiments. In various embodiments, sensor data, notifications, and/or requests may be sent from one distributed controller to the other.

The controller 302 of FIG. 3 and/or the controllers 402A, B and 404A, B of FIGS. 4A-4B may correspond to any of a variety of hardware controllers. In some embodiments, such controller may correspond to hardware/firmware/software systems. As an example, FIG. 5 illustrates a computer system 500 used with pump down operations in accordance with an embodiment of the disclosure. The computer system 500 comprises a computer 502 with one or more processors 504 coupled to a system memory 506. Some embodiments of the computer 502 also include a communication interface 526 and I/O devices 528 coupled to the processor 504. The computer 502 is representative of a desktop computer, server computer, notebook computer, handheld computer, or smart phone, etc.

The processor 504 is configured to execute instructions read from the system memory 506. The processor 504 may, for example, be a general-purpose processor, a digital signal processor, a microcontroller, etc. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems.

The system memory 506 corresponds to random access memory (RAM), which stores programs and/or data structures during runtime of the computer 502. For example, during runtime of the computer 502, the system memory 506 may store a pump down control application 514, which is loaded into the system memory 506 for execution by the processor 504.

The system 500 also may comprise a computer-readable storage medium 505, which corresponds to any combination of non-volatile memories such as semiconductor memory (e.g., flash memory), magnetic storage (e.g., a hard drive, tape drive, etc.), optical storage (e.g., compact disc or digital versatile disc), etc. The computer-readable storage medium 505 couples to I/O devices 528 in communication with the processor 504 for transferring data/code from the computer-readable storage medium 505 to the computer 502. In some embodiments, the computer-readable storage medium 505 is locally coupled to I/O devices 528 that comprise one or more interfaces (e.g., drives, ports, etc.) to enable data to be transferred from the computer-readable storage medium 505 to the computer 502. Alternatively, the computer-readable storage medium 505 is part of a remote system (e.g., a server) from which data/code may be downloaded to the computer 502 via the I/O devices 528. In such case, the I/O devices 528 may comprise networking components (e.g., a network adapter for wired or wireless communications). Regardless of whether the computer-readable storage medium 505 is local or remote to the computer 502, the code and/or data structures stored in the computer-readable storage medium 505 may be loaded into system memory 506 for execution by the processor 504. For example, the pump-and-perf control application 514 or other software/data structures in the system memory 506 of FIG. 5 may have been retrieved from computer-readable storage medium 505.

The I/O devices 528 also may comprise various devices employed by a user to interact with the processor 504 based on programming executed thereby. Exemplary I/O devices 528 include video display devices, such as liquid crystal, cathode ray, plasma, organic light emitting diode, vacuum fluorescent, electroluminescent, electronic paper or other appropriate display panels for providing information to the user. Such devices may be coupled to the processor 504 via a graphics adapter. Keyboards, touchscreens, and pointing devices (e.g., a mouse, trackball, light pen, etc.) are examples of devices includable in the I/O devices 528 for providing user input to the processor 504 and may be coupled to the processor by various wired or wireless communications subsystems, such as Universal Serial Bus (USB) or Bluetooth interfaces.

As shown in FIG. 5, the pump down control application 514 comprises wireline control instructions 516, pump control instructions 518 and control parameters 520. When executed, the wireline control instructions 516 operate to generate commands for a wireline unit 536 coupled to the computer 502 via the communication interface 526. Likewise, the pump control instructions 518, when executed, operate to generate commands for a pump unit 534 coupled to the computer 502 via the communication interface 526. The generation of commands by the wireline control instructions 516 and the pump control instructions 518 may be based on monitored control parameters 520 such as wireline speed, wireline tension and/or pump rate. The monitored control parameters 520 may be received during pump down operations from sensors 532 coupled to the communication interface 526. Alternatively, the sensors 532 provide wireline data and pump data from which the monitored control parameters 520 are calculated. In either case, the received or derived control parameters 520 are stored in the computer 502 for access by the pump down control application 514.

In at least some embodiments, the commands generated by the pump control instructions 518 for the pump unit 534 cause the pump unit 534 to change its pump rate. For example, the pump control instructions 518 may generate a reduce pump rate command for the pump unit 534 in response to an increase in the monitored wireline speed and/or an increase in the monitored wireline tension. Alternatively, the pump control instructions 518 may generate an increase pump rate command for the pump unit 534 in response to a decrease in the monitored wireline speed and/or a decrease in the monitored wireline tension. Further, the wireline control instructions 516 may generate a decrease wireline speed command for the wireline unit 536 in response to a decrease in the monitored pump rate. In this manner, efficiency of pump down operations is improved while also considering safety thresholds.

FIG. 6 illustrates a method 600 in accordance with an embodiment of the disclosure.

Though depicted sequentially as a matter of convenience, at least some of the actions shown can be performed in a different order and/or performed in parallel. Additionally, some embodiments may perform only some of the actions shown. In some embodiments, the operations of FIG. 6, as well as other operations described herein, can be implemented as instructions stored in a computer-readable storage medium (e.g., computer-readable storage medium 505) and executed by a processor (e.g., processor 504).

The method 600 starts by monitoring a wireline speed (block 602) and monitoring a wireline tension (block 604). The monitoring may be performed by sensors in communication with a hardware controller or a computer running software. In some embodiments, pressure and rate sensors could be monitored, if need be, from a transducer and flowmeter in the line rather than from the pump directly. A pump rate for pump down operations is then set based on the monitored wireline speed and monitored wireline tension (block 606). If changes to control parameters occur during pump down operations (determination block 608), the pump rate is automatically updated in response to the changes (block 610). In at least some embodiments, the control parameters correspond to the monitored wireline speed and the monitored wireline tension. For example, the pump rate may be decreased during pump down operations in response to a reduction in the monitored wireline speed. The amount of decrease in the pump rate may correspond to the difference between the monitored wireline speed and a predetermined threshold. The method 600 may additionally comprise receiving sensor data and determining the wireline speed and the wireline tension from the sensor data. Further, the method 600 may additionally comprise changing a wireline speed in response to a monitored pump rate during pump down operations.

A number of implementations have been described. Nevertheless, it will be understood that various modifications may be made. Further, the method 600 may include fewer steps than those illustrated or more steps than those illustrated. In addition, the illustrated steps of the method 600 may be performed in the respective orders illustrated or in different orders than that illustrated. As a specific example, the method 600 may be performed simultaneously (e.g., substantially or otherwise). Other variations in the order of steps are also possible. Accordingly, other implementations are within the scope of the following claims.

What is claimed is:

1. A system for pump down operations in a wellbore, comprising:

(a) a tool string disposed in the wellbore, said tool string comprising:
- a cable head having an upper end coupled to an electric wireline cable;
- a downhole tool coupled to the cable head, the downhole tool selected from a group consisting of perforating tools and downhole logging tools; and
- a downhole tension sensor located in the tool string, said sensor adapted to obtain downhole wireline tension data and transmit the downhole wireline tension data via the electric wireline cable;

(b) a fluid pump with a fluid output operatively connected to the wellbore above the tool string; and (c) a controller adapted to selectively adjust a pump fluid output rate of the fluid pump during pump down operations based on the downhole wireline tension data received from the downhole tension sensor.

2. The system of claim 1 further comprising a wireline speed sensor in communication with the controller, wherein the controller is adapted to selectively adjust the pump fluid output rate during pump down operations based on wireline speed data received from the wireline speed sensor.

3. The system of claim 2 wherein the wireline speed sensor is an accelerometer located in the tool string and wherein the wireline speed sensor transmits downhole wireline speed data to at least one controller located at a surface.

4. The system of claim 2 wherein the wireline speed sensor is located in the tool string and wherein the wireline speed sensor transmits a downhole wireline speed data to at least one controller located at a surface.

5. The system of claim 4 wherein the wireline speed sensor comprises a casing collar locator disposed in the tool string and another controller operable to calculate the speed at which the casing collar locator is passing between known casing collars spaced apart at previously known distances between the known casing collars.

6. The system of claim 5 wherein the controller is operable to compare the calculated speed as the casing collar locator passes additional known casing collars and determine when the calculated speed is increasing or decreasing.

7. A system for pump down operations in a wellbore, comprising:

(a) a tool string disposed in the wellbore, said tool string including:
- a cable head having an upper end coupled to an electric wireline cable;
- a downhole tool coupled to the cable head, the downhole tool selected from a group consisting of perforating tools and downhole logging tools; and
- a downhole wireline speed sensor located in the tool string and in communication with a controller, wherein the controller is adapted to selectively adjust a pump fluid output rate during pump down operations based on downhole wireline speed data received from the downhole wireline speed sensor; and (b) a fluid pump with a fluid output operatively connected to the wellbore above the tool string.

8. The system of claim 7 wherein the downhole wireline speed sensor is an accelerometer located in the tool string and wherein the speed sensor is adapted to calculate the downhole wireline speed and transmit said downhole wireline speed to at least one controller.

9. The system of claim 8 further including a downhole tension sensor located in the tool string, said sensor adapted to obtain downhole wireline tension data and transmit the downhole wireline tension data to a controller located at a surface.

10. The system of claim 9 wherein the controller is adapted to adjust the pump rate based on the downhole wireline speed unless the downhole wireline tension data reaches a predetermined wireline tension threshold, after which the controller is adapted to automatically reduce a speed of the wireline at the surface.

11. The system of claim 9, wherein the controller is adapted to selectively adjust the pump fluid output rate during pump down operations based on downhole wireline tension data received from the downhole tension sensor.

12. The system of claim 9 wherein the controller is adapted to selectively adjust the wireline speed during pump down operations based on downhole wireline tension data received from the downhole tension sensor.

13. The system of claim 7 wherein the downhole wireline speed sensor comprises a casing collar locator disposed in the tool string and another controller operable to calculate the speed at which the casing collar locator is passing between known casing collars spaced apart at previously known distances between the known casing collars.

14. The system of claim 13 wherein the controller is operable to compare the calculated speed as the casing collar locator passes additional known casing collars and determine when the calculated speed is increasing or decreasing.

15. The system of any of claim 14 wherein the controller is operable to send a signal to adjust either a wireline speed at a surface or the pump fluid output based on the downhole wireline speed.

16. The system of claim 7 wherein the controller comprises a wireline controller that is part of the tool string and a pump controller located at a surface.

17. The system of claim 16 wherein the wireline controller is adapted to notify the pump controller that a monitored downhole wireline speed is less than a predetermined threshold and the pump controller is adapted to increase the pump fluid output rate in response to said notification.

18. The system of any of claim 16 wherein the wireline controller is adapted to notify the pump controller that a monitored wireline tension is more than a predetermined threshold and the pump controller is adapted to decrease the pump fluid output rate of in response to said notification.

19. A method for pumping a tool string connected to an electric wireline into a wellbore, comprising:

(a) inserting a logging tool string into a proximal upper end of the wellbore, said logging tool string comprising:

a cable head attached to an electric wireline cable, a downhole tension sensor located in the tool string, said sensor adapted to obtain downhole wireline tension data and transmit the downhole wireline tension data via the electric wireline cable; and a downhole wireline speed sensor located in the tool string;

(b) pumping a fluid into the wellbore above the tool string to assist, via fluid pressure on the tool string, movement of the tool string down the wellbore;

(c) spooling out the cable at a surface as the fluid is pumped behind the tool string and the tool string is moving down the wellbore;

(d) receiving by at least one controller downhole wireline tension data from the downhole tension sensor via the electric wireline cable; and (e) receiving by the at least one controller downhole wireline speed data from the downhole wireline speed sensor via the electric wireline cable.

20. The method of claim 19 further including determining when the logging tool string speed is increasing or decreasing.

21. The method of claim 19 further comprising receiving downhole sensor data and determining the wireline speed and the wireline tension from the sensor data.

22. The method of claim 21 further comprising increasing a pump rate in response to a reduction in the determined wireline speed.

23. The method of claim 22 further comprising changing the pump rate in accordance with a difference between the determined wireline speed and a predetermined threshold.

24. The method of claim 21 further comprising changing the wireline speed in response to a monitored pump rate.

25. The method of claim 21 further comprising:

monitoring by a controller a pump rate for pumping the tool into the wellbore; and automatically controlling, by the controller, a wireline speed for the tool being pumped into the wellbore based on at least the monitored pump rate.

26. The method of claim 21 further comprising:

monitoring, by a controller, a downhole wireline speed;

monitoring, by the controller, a downhole wireline tension; and automatically controlling, by the controller, a pump rate for pumping the tool into the wellbore based on at least one of the monitored downhole wireline speed and monitored downhole wireline tension.

* * * * *